United States Patent [19]

Wang

[11] Patent Number: 4,644,693

[45] Date of Patent: Feb. 24, 1987

[54] ELECTRIC DEVICE FOR OPENING OR SHUTTING AUTOMATIVE DOORS

[76] Inventor: Hong J. Wang, 14-3, Fu Shin 1 Rd., Kaohsiung, Taiwan, 800

[21] Appl. No.: 767,603

[22] Filed: Aug. 20, 1985

[51] Int. Cl.[4] ..... E05F 15/00

[52] U.S. Cl. ..... 49/280; 49/358; 49/356

[58] Field of Search ..... 49/358, 356, 389, 340, 49/362, 280

[56] References Cited

U.S. PATENT DOCUMENTS

| | | | |
|---|---|---|---|
| 1,937,662 | 12/1933 | Nicholson | 49/362 X |
| 3653,154 | 4/1972 | Hayday | 49/358 X |
| 4,530,185 | 7/1985 | Moriya et al. | 49/356 X |

FOREIGN PATENT DOCUMENTS

| | | | |
|---|---|---|---|
| 1962763 | 6/1971 | Fed. Rep. of Germany | 49/359 |

*Primary Examiner*—Kenneth Downey

*Attorney, Agent, or Firm*—Holman & Stern

[57] ABSTRACT

This invention concerns about an electric device for opening or shutting automotive doors, which comprises a transmitting device controlling opening or shutting the door and an electromagnetic coil controlling the door lock. The transmitting device uses a motor and an electromagnetic clutch which are able to operate to open or close the door by pushing of a rack and attain the aim of automatically controlling the opening or closing of the door.

2 Claims, 8 Drawing Figures

ELECTRIC DEVICE FOR OPENING OR SHUTTING AUTOMATIVE DOORS

BACKGROUND OF THE INVENTION

Nowadays, the electric automatic device for opening or shutting automative doors are divided into two types—one controlled by a lever and other by air. The device controlled by a lever, utilizing the principle of a lever, depends on the transmission of a transmitting rod, which makes it easy for a driver to control opening or shutting the door. But the transmitting rod must be fixed nakedly inside of a car without any cover, spoiling the original interior view of a car and having the possibility of hooking the passenger's clothes and more severely, preventing a passenger from getting down in case of a bad taxi driver—for as long as the operating pole is lightly held by the driver, the door can not be opened. Therefore, this device has a few defects.

As for the device controlled by air, it makes use of a cylinder placed between the door and the car body and the cylinder is to be operated by the vaccum suction force generated by the work of the engine, pushing to open or shut the door. But, since the action of such a device involves using a engine, it is more complicated than the former one in fitting or servicing. In addition, this device can only be operated while the car is being driven, for it can not work unless the engine is working. Moreover, the cylinder must have some extent of volume large enough to move the door, and thus this type is not suitable for a smaller car. In order to improve the defects mentioned above, the inventor has studied hard to work out this invention. Therefore, the main objective of this invention is to provide a device having a small volume without spoiling the car interior view not only able to control the door under any condition but also able to permit a passenger to open the door manually.

BRIEF DESCRIPTION OF THE INVENTION

An embodiment of this invention with reference to the illustrating figures is to be described as follows.

Figure 1:
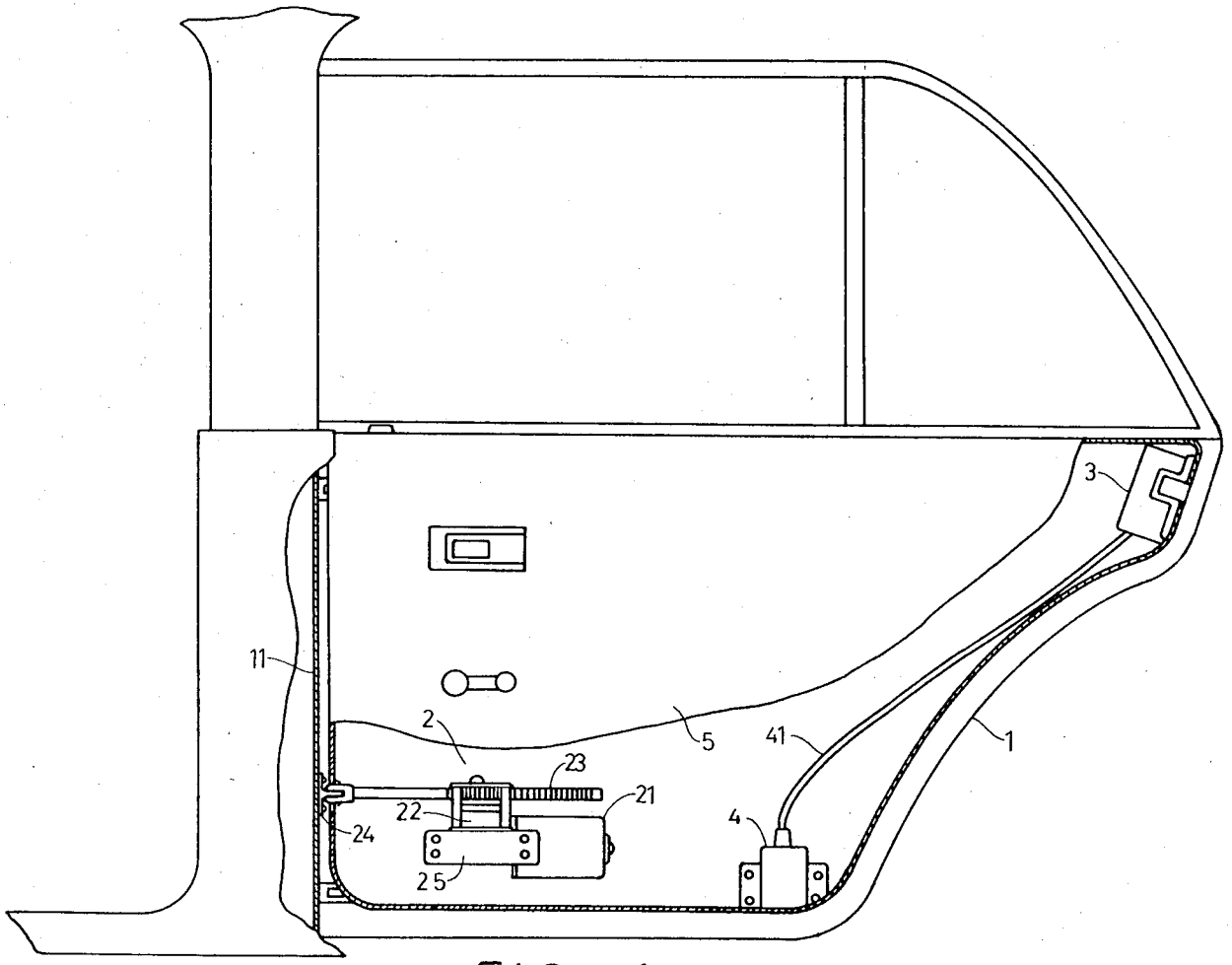
FIG. 1 is the structural view of the whole electric device for opening or shutting an automative door in this invention.

The FIG. 1 is a flat illustration of this invention, the front view of the back door inside a car. This invention, as shown in the figure, consists of a transmitting device 2 controlling the door 1 and an electromagnetic coil controlling the lock 3. The transmitting device 2 and the electromagnetic coil 4 are all fixed up on the bottom of the interior of the door 1 to avoid spoiling the structure of the door 1.

Figures 2, 3:
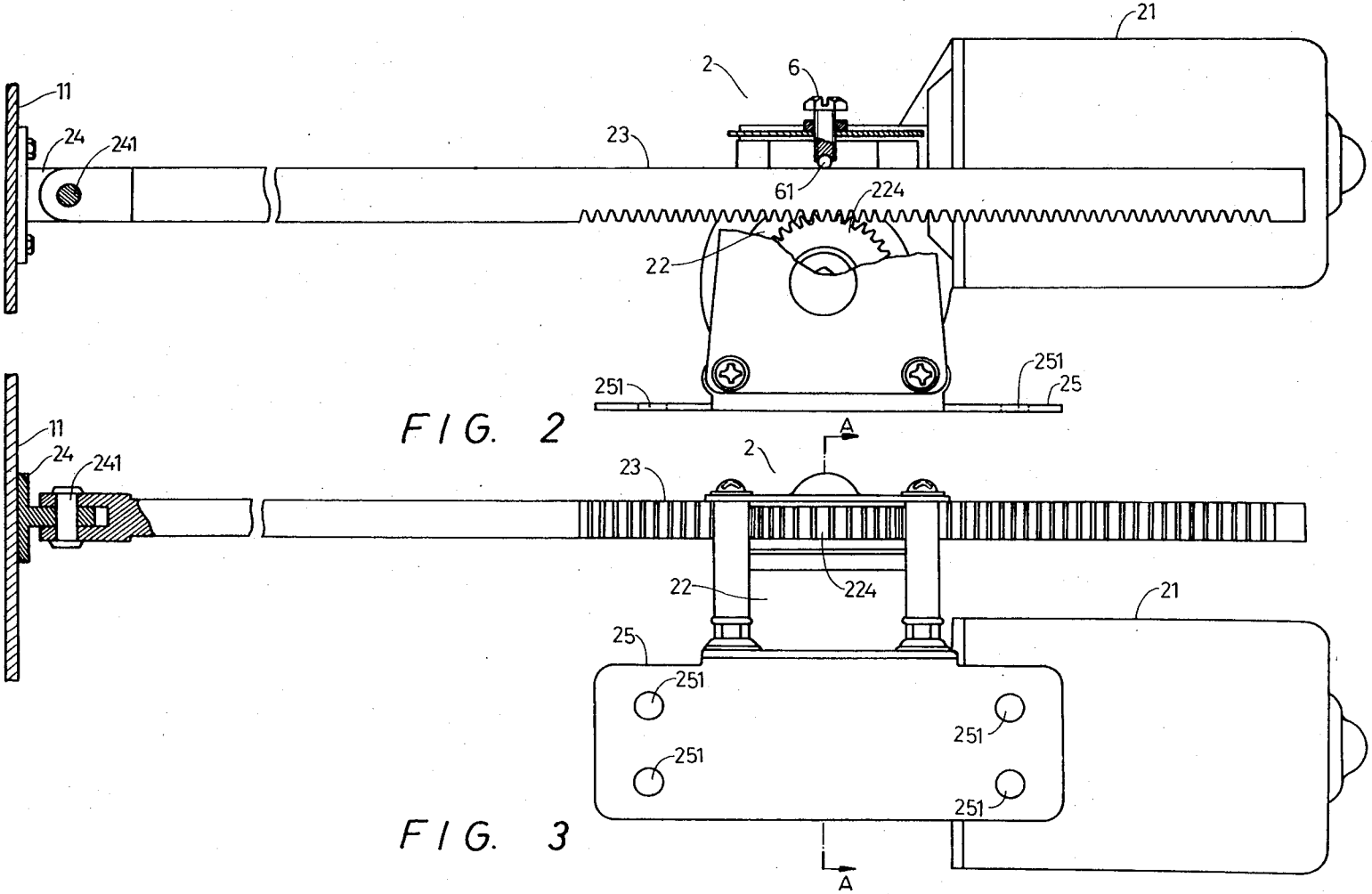
FIG. 2 is the upside view of the transmitting device in this invention.
FIG. 3 is the front view of the transmitting device in this invention.

FIG. 2 is the top view, and the FIG. 3 is the front view of the transmitting device 2. From these FIGS. 2, 3 it is clear that the transmitting device 2 comprises a motor 21, an electromagnetic clutch 22, a rack 23, a linking base 24, a combining base 25, and a transmitting shaft 26. On the combining base 25, there are holes 251 through which bolts are screwed to fix up the whole transmitting device 2 on the inside of the inner plate of the door 1. And the linking base 24 is fixed by screwed on the middle pole 11 of the door and connects with the rack 23 by a pin 241 enabling the rack 23 to swing with the pin 241 as a fulcrum.

Figure 4:
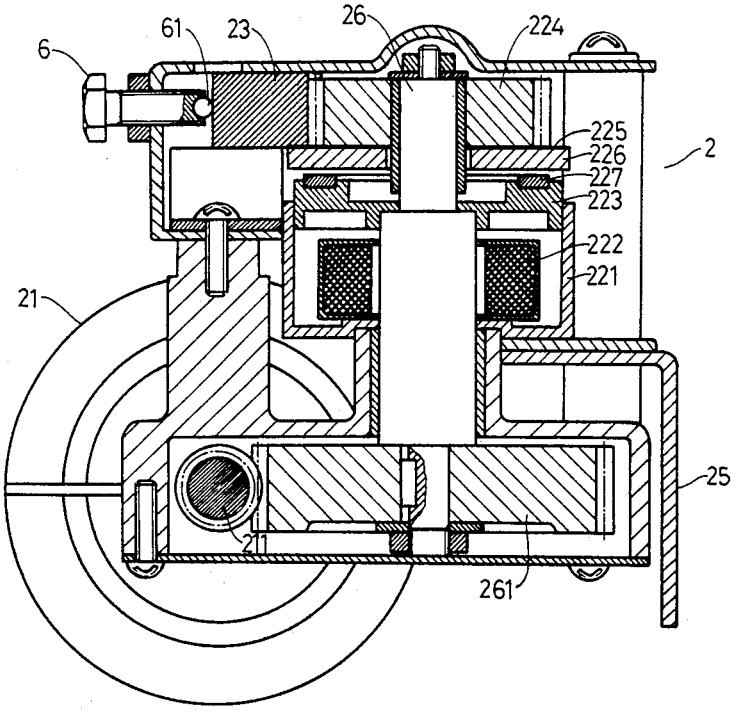
FIG. 4 is the cross-section view of A—A of the FIG. 3.
Figure 5:
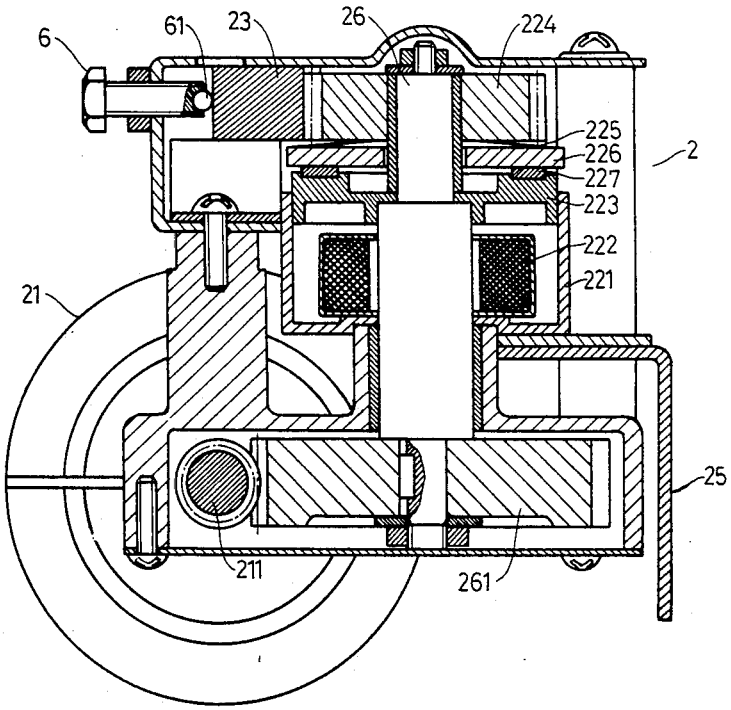
FIG. 5 is the diagram of the action of the electromagnetic clutch in this invention.

The FIG. 4 is the A—A cross-section view of the FIG. 3. The front of the shaft 211 of the motor 21 is cut with gear teeth which are to engage with those of a gear wheel 261 fixed on the bottom of the transmitting shaft 26 so that the motor 21 is able to drive the transmitting shaft 26 to turn around. In addition, an electromagnetic clutch 22 attached at the upper part of the tranmsitting shaft 26 includes a cover 221, an electric coil 222, a suction disc 223 and a gear wheel 224. The coil 222 surrounds the transmitting shaft 26; the suction disc 223 is fixed on the transmitting shaft 26; the gear wheel 224 is combined with the upper end of the transmitting shaft 26 in the way that it can revolve freely. When the electromagnetic clutch 22 does not work, the transmitting shaft 26 will drive the suction disc 223 to turn around but not the gear wheel 224. And a thin steel plate 225 set at the bottom of the gear wheel 224 is placed on a bottom plate 226 which can be sucked down by the sucking strength grown in the suction disc 223 so that the gear wheel 224 together with the plate 226 can be driven to turn around at the same time as the coil 222 is magnetized, as shown in the FIG. 5. But even when the coil 222 is not magnetized, the gear wheel 224 can revolve freely with the transmitting shaft 26 as its center. Also, a braking plate 227 set on the suction disc 223 can prevent the plate 226 from slipping and increase the friction strength between them and accordingly the efficiency of revolving. In the FIGS. 4, 5 it can be seen that gear wheel 224 and the rack 23 engage with each other. Set on side part of the rack 23 is an adjusting bolt 6 that possesses a steel ball at its end. The adjusting bolt 6 is to push the rack 23 to engage with the gear wheel 224 properly and enable the rack 23 to incline with the bolt tip functioning as a fulcrum.

Figure 6:
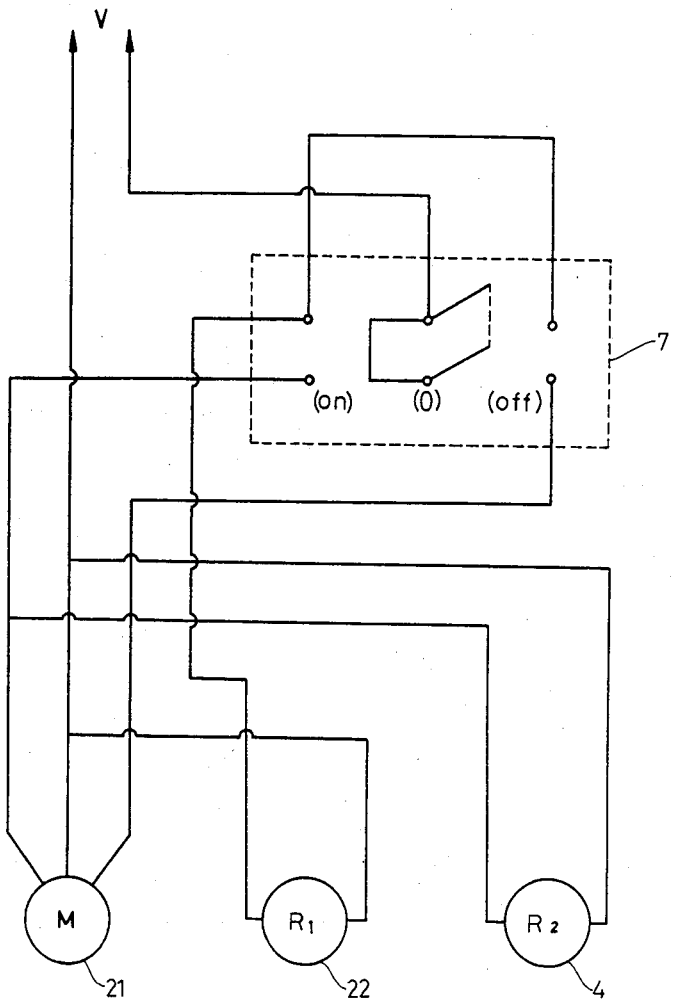
FIG. 6 is the diagram of the electric circuit in this invention.

The FIG. 6 is an electric circuit used in this invention. As can be seen, it uses a two-pole three-stage switch as a controlling switch 7. When the switch 7 is pulled to the ON position, it represents that the door can be opened, that is, the motor 21, the electromagnetic clutch 22 and the electromagnetic coil 4 will operate at the same time to get ready for opening the door.

When the switch 7 is pulled to the OFF position, it represents that the door is to be closed. In other words, it can control the motor 21 and the electromagnetic clutch 22 to operate at the same time to make the door closed. And if the switch 7 is pulled to the middle it represents that power is cut off not controlling of any parts of the device.

As mentioned previously, the electromagnetic coil 4 is the same as that commonly used, except that its core is connected with a wire rope 41 to the door lock 3 which can be opened by the pulling of the wire rope 41 when the electromagnetic coil 4 works.

Figure 7:
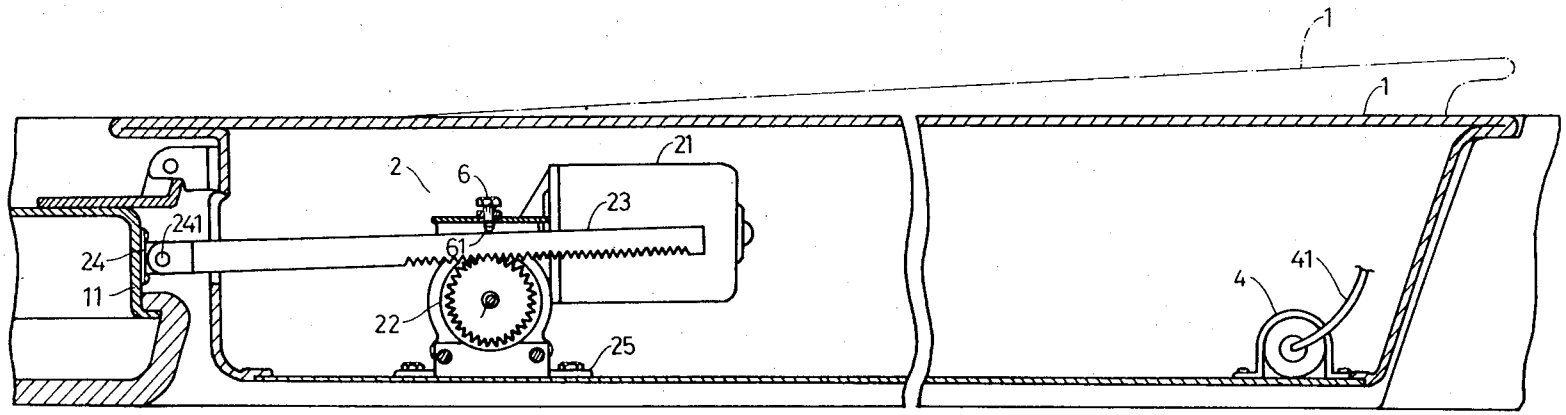
FIG. 7 is the view of the opening action of a car door with the whole device in this invention. (I)
Figure 8:
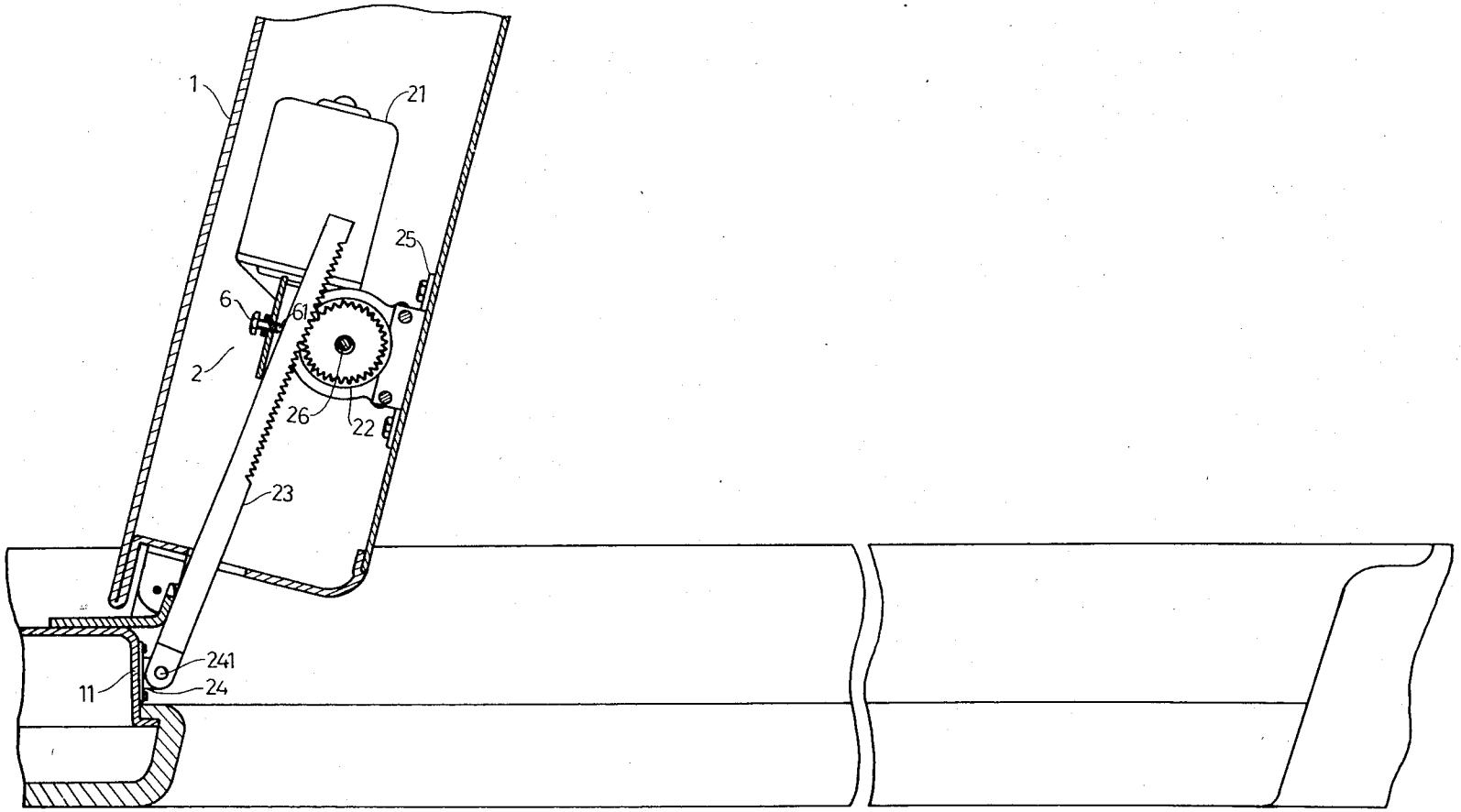
FIG. 8 is the view of the opening action of a car door with the whole device in this invention. (II)

As shown in the FIGS. 7, 8 they are the diagrams showing the action of this invention. When the switch 7 is turned to "ON", the electromagnetic coil 4 will start working forcing the wire rope 41 to pull up the lock 3 for opening as shown in the FIG. 7 and initiating action of the motor 21 and the electromagnetic clutch 22 in which the motor 21 will successively drive the shaft 211, the gear wheel 261, the transmitting shaft 26 and the gear wheel 224 to turn in order. Moreover, since the gear wheel 224 engages with the rack 23 and one end of the rack 23 is fixed on the middle pole 11 of the door 1 via the linking base 24 and the whole transmitting device 2 is fixed on the door 1, so the door can be opened when the gear wheel 224 turns to move the rack 23 as shown in the FIG. 8. If the door is expected to be closed, the switch 7 has to be moved to "OFF" so that the motor 21 will turn reversely to get the door 1 closed.

In addition, the rack 23 can not only swing with the pin 241 as a pivot which is connected with the linking base 24 but also incline its angle with bolt 6 as a fulcrum so as to make the door open completely.

Conclusively, as shown and illustrated in the above mentioned figures and embodiment, this invention uses a small motor whose revolution is transmitted by its shaft 211 to open the door 1. Therefore, the whole volume is so small that it can be set inside of the door 1 without spoiling the original interior view of a car. Besides, its operation involves nothing related with any driving parts of the car, so it can be operated even when the engine is not started up. Moreover, as the invention uses an electromagnetic clutch 22 to controll the transmission and the clutch 22 depends on the magnetic force, so when a car is not started up, the door can still be as easily opened or closed by a manual force as a common door can, or even when it is controlled by the driver, the door can be as well opened by a manual force, because the suction disc 223 of the gear wheel 224 can slip against each other with the transmitting shaft 26 spinning idle, getting rid of the revolving force of the transmitting shaft 26. Then a passenger can freely open the car door in case of necessity so that his freedom of action may not be dominated by the driver.

I claim:

1. An apparatus for opening and closing vehicle doors, comprising in combination:

a means for opening a door lock;

a means for moving a vehicle door;

said means for moving being mounted in a vehicle door;

said means for operating a door lock being mounted in the door;

said means for moving the door including a rack member;

said rack member having a pinned end and a free end;

said pinned end being pinned to a frame which does not move with the door;

said means for moving the vehicle door including an electrically operated motor connected to said rack; said motor being fixed to the door;

said motor having an output gear which is in toothed engagement with said rack;

a means for retaining said rack in engagement with said gear during angular motion of said rack relative to said motor;

a control means for controlling operation of said motor and operation of said door lock;

said control means having 3 states; in a first state, power is supplied to said means for controlling said door lock to open said door lock;

an electromagnetically operated clutch connected to said motor to transmit rotary motion from said motor to said output gear only when said clutch is energized;

in said first state, said control means also supplying power to said motor and to said clutch, whereby said motor operates in a forward direction to cause opening of the vehicle door;

in a second state, said control means cuts off power to said motor, said clutch, and said means for operating said door lock;

in a third state, said control means supplying power of a reversed polarity to said motor; said control means in said third state supplying power to said clutch but not to said means for opening said door lock; whereby said reversed polarity causes reversed movement of said motor to cause closing of the vehicle door;

in said second state, said clutch is disengaged from said output gear so as to permit manual operation of the vehicle door.

2. An apparatus as claimed in claim 1, wherein said means for retaining said rack to said output gear includes an adjusting bolt having a ball bearing at an end thereof in contact with said rack on an opposite side of said rack from said output gear, such that said rack can move angularly relative to said motor and said output gear during opening and closing of the vehicle door.

* * * * *